US005427546A

United States Patent [19]

Garritano et al.

[11] Patent Number: 5,427,546

[45] Date of Patent: Jun. 27, 1995

[54] FLEXIBLE JUMPER WITH SNAP-IN STUD

[75] Inventors: Mario Garritano, Oak Lawn; Howard O. Wedell, Oak Forest, both of Ill.

[73] Assignee: Methode Electronics, Inc., Chicago, Ill.

[21] Appl. No.: 168,672

[22] Filed: Dec. 16, 1993

[51] Int. Cl.[6] ..... H01R 11/00

[52] U.S. Cl. ..... 439/502; 439/507; 439/78

[58] Field of Search ..... 439/65, 78, 82, 502, 439/507, 513, 737, 751, 801

[56] References Cited

U.S. PATENT DOCUMENTS

| | | | |
|---|---|---|---|
| 1,046,465 | 12/1912 | Hoyt | 439/507 |
| 2,470,618 | 5/1949 | Holden | 439/65 |
| 3,069,682 | 12/1962 | Reese | 439/507 X |
| 3,212,046 | 10/1965 | Abel et al. | 439/507 X |
| 3,492,538 | 1/1970 | Fergusson | 439/67 |
| 4,752,250 | 6/1988 | Seidler | 439/751 |
| 5,049,089 | 9/1991 | Koenig | 439/507 X |

FOREIGN PATENT DOCUMENTS

| | | |
|---|---|---|
| 0177359 | 4/1986 | European Pat. Off. . |
| 1518296 | 3/1968 | France . |
| 0511473 | 10/1930 | Germany . |
| 0005303 | 2/1970 | Japan . |
| 0034083 | 3/1979 | Japan . |
| 0482383 | 1/1970 | Switzerland . |
| 1723606 | 3/1992 | U.S.S.R. . |

*Primary Examiner*—Khiem Nguyen
*Attorney, Agent, or Firm*—David L. Newman

[57] ABSTRACT

A flexible braided cable is provided including studs at each end for attachment to a printed circuit board. The stud includes a ferrule attached at the end of the cable. The stud is attached to the ferrule. The stud includes a cylindrical body having a head and neck. The body is separated into four (4) segments. The head includes a flange which upon frictional engagement with a hole of a printed circuit board causes the four (4) sections of the stud to compress. Upon insertion of the stud through a hole of a printed circuit board and protrusion of the flange through the second side of the printed circuit board, the stud expands back to its first position wherein the neck is flush with the sidewalls of the hole of the printed circuit board.

10 Claims, 2 Drawing Sheets

FLEXIBLE JUMPER WITH SNAP-IN STUD

BACKGROUND OF THE INVENTION

The present invention relates to an electrical connector for carrying current between circuit boards. In particular, the invention pertains to a flexible braided cable having studs at each end for carrying current between printed circuit boards or areas of a printed circuit board.

The use of multiple printed circuit boards within components is common and require in many applications that the current from one printed circuit board be carded to an adjacent printed circuit board. This has been commonly accomplished by the use of small wires or staples having 0.050 inch diameter. These small metal wire jumpers have been used to provide a current carrying pathway between printed circuit boards or between specific areas of a single printed circuit board. Commonly a power supply board is separated from a computer board and uses many small wires to carry current between the boards. The staples generally are delicate and have a limited current carrying capacity. The staples also easily crack or tear from the boards due to vibrations within components.

It is therefore an object of the present invention to provide an electrical connector which can carry high levels of current between printed circuit boards.

It is another object of the present invention to provide an electrical connector which has great strength and sturdiness while being flexible.

It is a further object of the present invention to provide an electrical connector which is easily inserted and attached to printed circuit boards.

SUMMARY OF THE INVENTION

A flexible braided cable is provided including studs at each end for attachment to a printed circuit board. The stud includes a ferrule attached at the end of the cable. The stud is attached to the ferrule. The stud includes a cylindrical body having a head and neck. The body is separated into four (4) segments. The head includes a flange which upon frictional engagement with a hole of a printed circuit board causes the four (4) sections of the stud to compress. Upon insertion of the stud through a hole of a printed circuit board and protrusion of the flange through the second side of the printed circuit board, the stud expands back to its first position wherein the neck is flush with the sidewalls of the hole of the printed circuit board.

The stud may also comprise a unitary member which receives a bolt for securement to a printed circuit board.

These and other features of the invention are set forth below in the following detailed description of the presently preferred embodiments.

DETAILED DESCRIPTION OF THE PRESENTLY PREFERRED EMBODIMENTS

The present invention relates to an improved flexible jumper cable for carrying current between printed circuit boards. The invention can be better understood by reference to FIG. 1–8 which show various aspects of a presently preferred embodiment of the invention.

Figure 1:
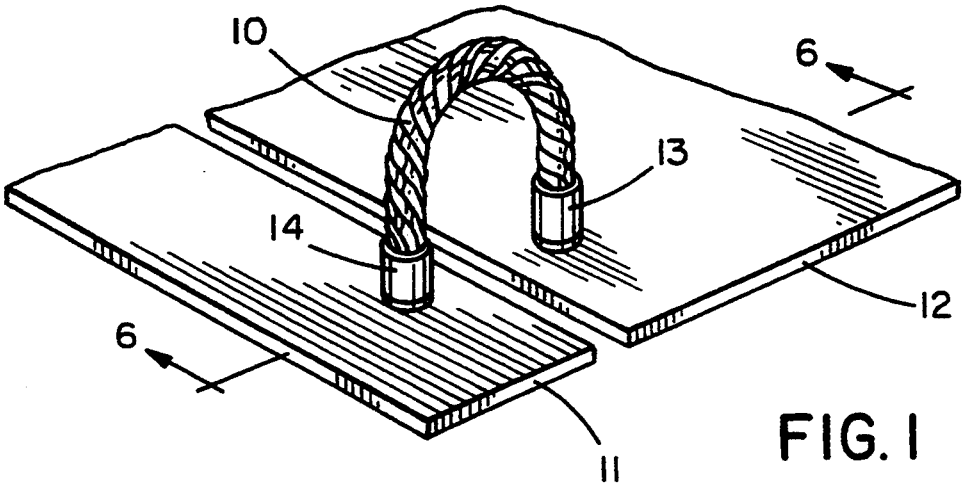
FIG. 1 is a perspective view of the jumper cable attached to a printed circuit board.

Turning to FIG. 1, a jumper cable 10 is shown attached to printed circuit boards 11,12. In a preferred embodiment of the invention, a cable consists of a lay tin coated cable. The cable is terminated by ferrules 13,14. In a preferred embodiment, the ferrules 13,14 comprise tin-coated copper ferrules. The assembly of the jumper cable 10 is formed of a cable which is flexible and may be formed in a U-shape to create the jumper. Each end of the jumper cable 10 can be quickly and easily snapped into a clearance hole of the printed circuit boards 11,12 or on different sections of a single circuit board. After attaching the cable to the printed circuit board, the board can be cut to create two (2) separate printed circuit boards connected by the jumper cables which allow the flexing of the printed circuit boards in 360°.

The use of the present invention to carry current overcomes many of the disadvantages of the prior art small wire jumpers. In a preferred embodiment, cable 10 is 8 gauge wire. Four (4) such cables can replace and carry more current than 60 (sixty) small 0.050 inch diameter wires. The cable 10 in a preferred embodiment has a 0.205 inch diameter. Also by decreasing the number of cables needed to carry current the density of the jumpers on the board decreases which in result decreases capacitive coupling.

Figure 2:
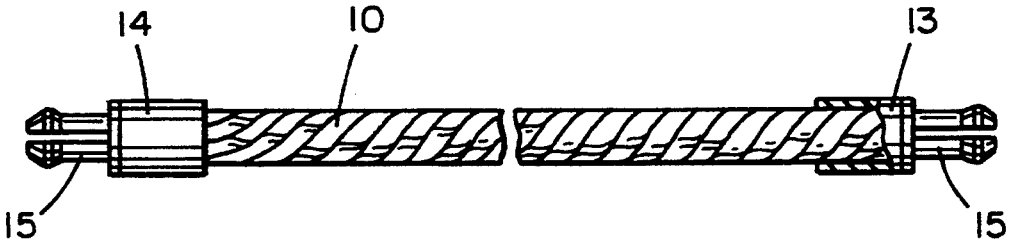
FIG. 2 is a side elevation view of the jumper cable.

Turning to FIG. 2, the jumper cable 10 is shown having ferrule 14 coveting the cable 10. The ferrule 13 is shown cut away. The ferrules 13,14 are swaged or compressed and attached to each end of the cable 10. In a preferred embodiment of the invention, a stud 15 is attached to the end of the cable 10 and the ferrule 13. The cable 10 may be any length suitable for connecting printed circuit boards. In a preferred embodiment of the invention, the cable is 2.0 inches ±0.10 inch.

Figure 3:
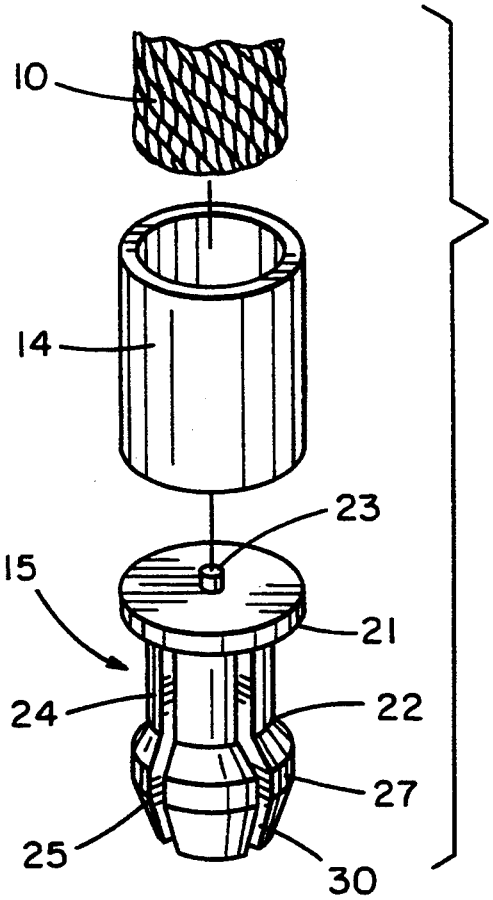
FIG. 3 is an exploded view of the end of the jumper cable.

FIG. 3 is an exploded view of the end of the cable 10 shown in FIG. 2. The ferrule 14 is slid over the end of cable 10 and is compressed and attached thereon. The stud 15 includes a base 21 and a body 22. The base 21 includes energy director 23 to dissipate heat upon fusion welding. The body includes a neck 24 and a head 25. The head 25 includes flange 27. The stud 15 is cross-slotted having longitudinal slots 30. The stud 15 is attached to ferrule 14 by welding. In a preferred embodiment the base 21 is fusion or explosion welded to ferrule 14.

Figure 4:
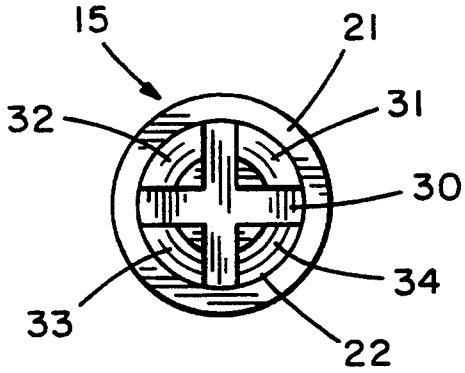
FIG. 4 is an end view of FIG. 2.

FIG. 4 is an end view of the cable of FIG. 2 having the stud 15 is attached thereto. Base 21 and head 22 of the stud 15 are shown. Slots 30 are shown which divide the head into four (4) segments. FIG. 4 shows the stud 15 in a first position wherein the segments 31,32,33,34 are at rest and not compressed.

Figure 5:
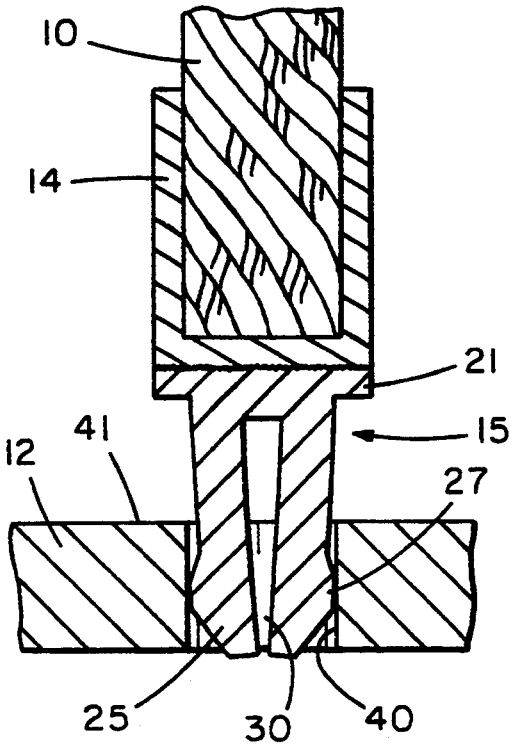
FIG. 5 is a side elevation cut-away view of the jumper cable being inserted into a printed circuit board.

Turning to FIG. 5, the jumper cable is shown being inserted and mated to a printed circuit board 12. The cable 10 has ferrule 14 attached and base 21 of stud 15 attached thereto. Stud 15 is partially inserted into hole 40 of printed circuit board 12. The head 25 of stud 15 initially makes contact with the walls of hole 40. The conical front surface of head 25 slides along the entrance of hole 40 on a first side 41 of printed circuit board 12. Flange 27 then frictionally engages walls 40. The protrusion of flange 27 forces the stud 15 to compress inwardly toward slot 30. The stud is shown in a second position wherein it is completely compressed and flange 27 is engaged within the walls of hole 40 of printed circuit board 12.

Figure 6:
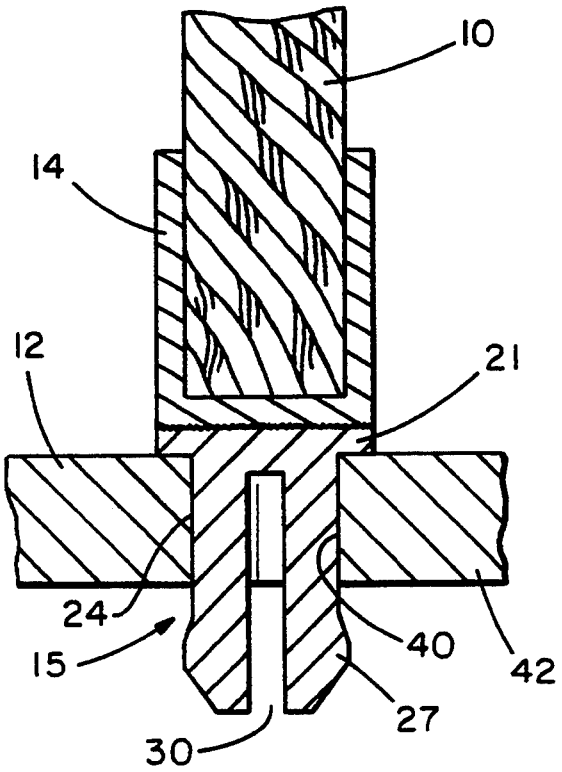
FIG. 6 is a side elevation cut-away view of the jumper cable taken at line 6—6 of FIG. 1 being fully mated with a printed circuit board.

FIG. 6 is a side elevation cut away view taken at line 6—6 of FIG. 1. The cable 10 is shown in its fully mated position with printed circuit board 12. Flange 27 is fully inserted through hole 40 and has exited at second side 42 of printed circuit board 12. The stud 15 is decompressed or has recovered so that slot 30 is fully opened and the head 15 has regained its first position and is at rest. In the fully mated position of stud 15, the neck 24 frictionally engages the walls of hole 40 of printed circuit board 12. The insertion of the cable 10 into printed circuit board 12 can be accomplished easily and quickly with one pushing motion in which the stud 15 provides a "snap-in" coupling. In that when the stud 15 goes from its second position shown in FIG. 5 to its fully mated position or first position in FIG. 6, the stud 15 snaps back to its first position and engages the printed circuit board 12. The stud 15 is then wave soldered to the printed circuit board 12. The wave soldering fills slot 30 of stud 15 providing for strong securement to the board 12. The printed circuit boards if not already separated may then be separated into two individual boards connected via the cable 10. The use of studs 15 do not require any trimming after insertion into printed circuit board 12.

Figure 7:
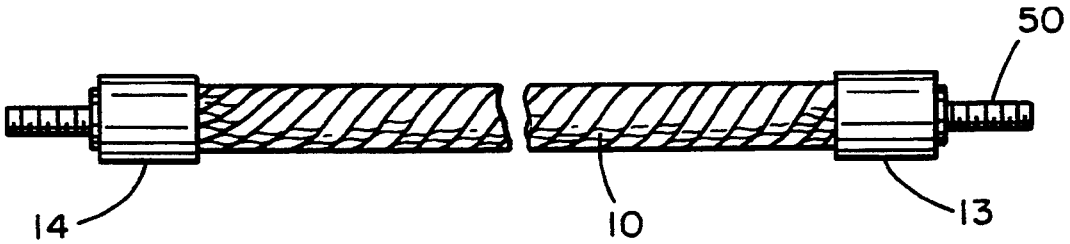
FIG. 7 is a side elevation view of an alternative embodiment of the present invention.

Turning to FIG. 7, an alternative embodiment of the present invention is shown. Cable 10 is shown having its ends terminated by ferrules 13,14. This embodiment differs from the previously described embodiment in that threaded stud 50 is attached to the ferrules 13,14 and the end of the cable 10.

Figure 8:
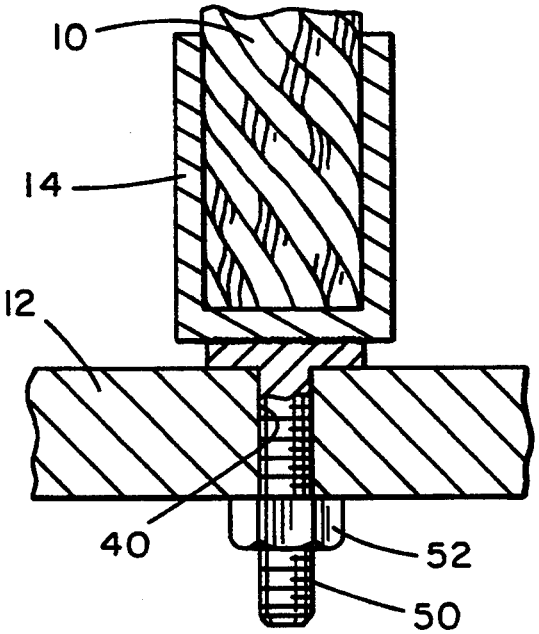
FIG. 8 is a side elevation cut-away view of the alternative embodiment shown in FIG. 7 mated to a printed circuit board.

FIG. 8 shows the cable 10 of the alternative embodiment attached to a printed circuit board 12. The threaded stud 50 is inserted through a hole 40 of printed circuit board 12. Upon insertion, a hex nut 52 is secured onto the threaded stud 50 to secure the cable 10 to printed circuit board 12. The threaded stud 50 is then trimmed and the end is then soldered to printed circuit board 12.

The description above has been offered for illustrative purposes only, and it is not intended to limit the scope of the invention of this application which is defined in the following claims.

What is claimed is:

1. An electrical connector for carrying current between printed circuit boards comprising:

a braided cable;

a stud attached to an end of said braided cable, said stud having a head having an increased diameter flange adjacent a conical front surface at an end of said stud; and said stud inserted through a printed circuit board with said increased diameter flange protruding through a hole in said printed circuit board.

2. The connector of claim 1 wherein said stud is soldered to said printed circuit board.

3. The connector of claim 1 wherein said stud is snap-fit into said printed circuit board.

4. The connector of claim 3 wherein said stud includes a longitudinal slot providing for individual segments of said stud.

5. The connector of claim 1 wherein upon insertion into a hole of said printed circuit board said conical front surface slidingly engages walls of said hole at a first side of said printed circuit board.

6. An electrical connector for carrying current comprising:

a braided cable;

a stud attached to an end of said braided cable, said stud having an increased diameter flange adjacent a conical front surface at an end of said stud with said increased diameter flange protruding through a hole in a printed circuit board; and a longitudinal slot within said stud.

7. A method of carrying current between printed circuit boards comprising the steps of:

forming a hole in a printed circuit board;

inserting in said hole a braided cable having a stud attached to an end of said braided cable, said stud having an increased diameter flange adjacent a conical front surface at an end of said stud; and soldering said stud to said printed circuit board with said increased diameter flange protruding through said hole in said circuit board.

8. The method of claim 7 including the step of separating said printed circuit board into two (2) or more segments.

9. The method of claim 7 wherein before said inserting of said stud, compressing a longitudinal slot within said stud, and, after said stud is inserted, decompressing said longitudinal slot.

10. The method of claim 7 wherein said inserting of said braided cable comprises the steps of:

aligning said stud to said hole;

engaging a conical front surface of said stud into said hole;

inserting said stud into said hole;

frictionally sliding said conical front surface into said hole causing said stud to compress;

pushing said stud completely through said hole; and decompressing said stud.

* * * * *